US012349848B2

(12) United States Patent
Trenda et al.

(10) Patent No.: US 12,349,848 B2
(45) Date of Patent: Jul. 8, 2025

(54) REUSABLE HAND ARTICLE FOR CLEANING

(71) Applicants: Gary Trenda, Valencia, CA (US); Tiffany Trenda, Culver City, CA (US); Todd Trenda, Valencia, CA (US)

(72) Inventors: Gary Trenda, Valencia, CA (US); Tiffany Trenda, Culver City, CA (US); Todd Trenda, Valencia, CA (US)

( * ) Notice: Subject to any disclaimer, the term of this patent is extended or adjusted under 35 U.S.C. 154(b) by 1122 days.

(21) Appl. No.: 17/031,409

(22) Filed: Sep. 24, 2020

(65) Prior Publication Data

US 2021/0000319 A1 Jan. 7, 2021

Related U.S. Application Data

(63) Continuation-in-part of application No. 16/186,968, filed on Nov. 12, 2018, now abandoned.

(60) Provisional application No. 62/590,476, filed on Nov. 24, 2017.

(51) Int. Cl.

| | |
|---|---|
| ***A47L 13/18*** | (2006.01) |
| ***A41D 19/00*** | (2006.01) |
| ***A41D 19/01*** | (2006.01) |

(52) U.S. Cl.

CPC ..... *A47L 13/18* (2013.01); *A41D 19/0024* (2013.01); *A41D 19/01* (2013.01)

(58) Field of Classification Search

CPC ..... A47L 13/18; A47L 13/19; A47L 13/26; A41D 19/0024

USPC ..... 15/227

See application file for complete search history.

(56) References Cited

U.S. PATENT DOCUMENTS

| | | | | |
|---|---|---|---|---|
| 4,959,881 | A | 10/1990 | Murray | |
| 5,088,121 | A | 2/1992 | Wallace | |
| 5,345,368 | A | 9/1994 | Huff | |
| 5,943,701 | A | 8/1999 | Seats | |
| 6,018,837 | A | 2/2000 | Andreu | |
| 6,019,854 | A | 2/2000 | Thomas | |
| 6,393,614 | B1 | 5/2002 | Eichelbaum | |
| 6,539,549 | B1 | 4/2003 | Peters, Jr. | |
| 6,604,244 | B1 | 8/2003 | Leach | |
| 7,033,100 | B2 | 4/2006 | Barton et al. | |
| 7,636,978 | B2 | 12/2009 | Blokpoel | |
| 8,522,363 | B2 | 9/2013 | Hassan et al. | |
| 9,402,454 | B2 * | 8/2016 | Landy | A47L 1/15 |
| 9,635,992 | B2 | 5/2017 | Redd | |

(Continued)

*Primary Examiner* — Laura C Guidotti

(74) *Attorney, Agent, or Firm* — Boudwin Intellectual Property Law, LLC; Daniel Boudwin

(57) ABSTRACT

A reusable hand article for cleaning is provided. The reusable hand article includes a sleeve, having a top layer and a bottom layer, that can receive a hand therein. The bottom layer is attached to a water-resistant layer, which is attached to an absorbent layer. The absorbent layer absorbs a cleaning solution therein, and the water-resistant layer isolates and protects the hand from the cleaning solution. The top layer is attached to an abrasive layer, which aids a user in scrubbing a surface to remove accumulated dirt and grime therefrom. After placing the hand in the sleeve, applying the cleaning solution to the absorbent layer, and scrubbing the surface with the abrasive layer, the reusable hand article can be applied to the surface. The reusable hand article may be composed of one or more microwave-safe materials, enabling it to be microwaved for sterilization before storage or reuse.

2 Claims, 11 Drawing Sheets

(56) References Cited

U.S. PATENT DOCUMENTS

| | | | | |
|---|---|---|---|---|
| 2004/0250333 | A1 | 12/2004 | Friedman | |
| 2008/0178366 | A1* | 7/2008 | Daher | A47L 13/18 2/163 |
| 2008/0295219 | A1* | 12/2008 | Andersen | D04B 1/28 2/167 |
| 2009/0185851 | A1* | 7/2009 | Mapalo | B60S 3/045 206/229 |
| 2010/0083453 | A1 | 4/2010 | Abbas | |
| 2011/0167581 | A1* | 7/2011 | Arzarzar | B32B 1/00 15/227 |
| 2012/0210532 | A1* | 8/2012 | Slade, Jr. | A47L 13/18 15/227 |
| 2014/0157539 | A1* | 6/2014 | Megerdichian | A47L 13/18 15/227 |
| 2014/0250565 | A1 | 9/2014 | Willows et al. | |
| 2016/0324227 | A1 | 11/2016 | Bowen et al. | |
| 2017/0095017 | A1 | 4/2017 | Mirkarimi | |

* cited by examiner

REUSABLE HAND ARTICLE FOR CLEANING

CROSS REFERENCE TO RELATED APPLICATIONS

This application is a continuation-in-part of U.S. patent application Ser. No. 16/186,968 filed on Nov. 12, 2018, which in turn claims priority to U.S. Provisional Application No. 62/590,476 filed on Nov. 24, 2017. The above identified patent applications are incorporated by reference herein in their entirety to provide continuity of disclosure.

BACKGROUND OF THE INVENTION

The present invention relates to a reusable hand article for use in cleaning.

Many infectious agents, such as viruses and bacteria, are spread by touching surfaces having these infectious agents thereon. Sanitary wipes are popular for sanitizing surfaces to destroy or remove these infectious agents, but oftentimes these wipes include chemicals that can be harmful to an individual using them. In addition, due to their size and coverage capacity, effectively cleaning surfaces often requires a large number of sanitary wipes, which is costly and can also increase exposure of the individual to the harmful chemicals contained in the wipes. Further, sanitary wipes are not environmentally responsible. Landfills and other waste deposits include large amounts of these wipes, and because most wipes are non-degradable and can only be used once, they are regularly disposed, and accumulate rapidly.

Therefore, there is a need in the art for a reusable hand article for cleaning, that protects the individual from exposure to harmful chemicals used for cleaning, and which also is environmentally responsible. The present invention addresses this unmet need.

Articles have been disclosed in the art that relate to hand articles for cleaning. These include articles that have been patented and published in patent application publications. These articles are often single use only, or do not effectively isolate and protect the individual from exposure to harmful chemicals, or are not environmentally responsible. In view of the articles disclosed in the art, it is submitted that there is a need in the art for an improvement to existing hand articles for cleaning. In view of the present disclosure, it is submitted that the present invention substantially diverges in structural and functional elements from articles in the art, and substantially fulfills an unmet need in the art.

SUMMARY OF THE INVENTION

In view of the disadvantages inherent in the known types of hand articles for cleaning in the art, the present invention provides a reusable hand article for cleaning, wherein the same can be utilized as a protective and cost-effective cleaning article.

It is therefore an object of the present invention to provide a reusable hand article for cleaning.

In one aspect, the invention provides a reusable hand article for cleaning, comprising a sleeve, having a top layer connected to a bottom layer, having an opening on a rearward side thereof configured to receive a hand between the top layer and the bottom layer, and having a closed portion on a forward side thereof configured to secure the hand in the sleeve. A water-resistant layer is attached to an exterior of the bottom layer, and the water-resistant layer is configured to repel a liquid solution. An absorbent layer is attached to an outer surface of the water-resistant layer, and the absorbent layer is configured to absorb the liquid solution therein.

In some embodiments, the reusable hand article includes a flap disposed on an exterior of the hand article, and the flap is configured to removably secure an item, such as a bottle, therein. The bottle may include one or more cleaning solutions therein for storage of the cleaning solution with the reusable hand article, e.g., within the flap, to help an individual organize cleaning supplies. In such embodiments, to use the reusable hand article, a liquid or solution in the bottle is applied to the absorbent layer of the reusable hand article, which absorbs the liquid or solution. Thereafter, the liquid or solution is applied to one or more surfaces as part of a method of cleaning the one or more surfaces. During cleaning the water-resistant layer repels the liquid or solution and prevents the liquid or solution from contacting the hand within the sleeve. In this manner, the hand is not exposed to harmful or toxic chemicals within the liquid or solution during cleaning.

Another object of the present invention is to provide a reusable hand article for cleaning that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
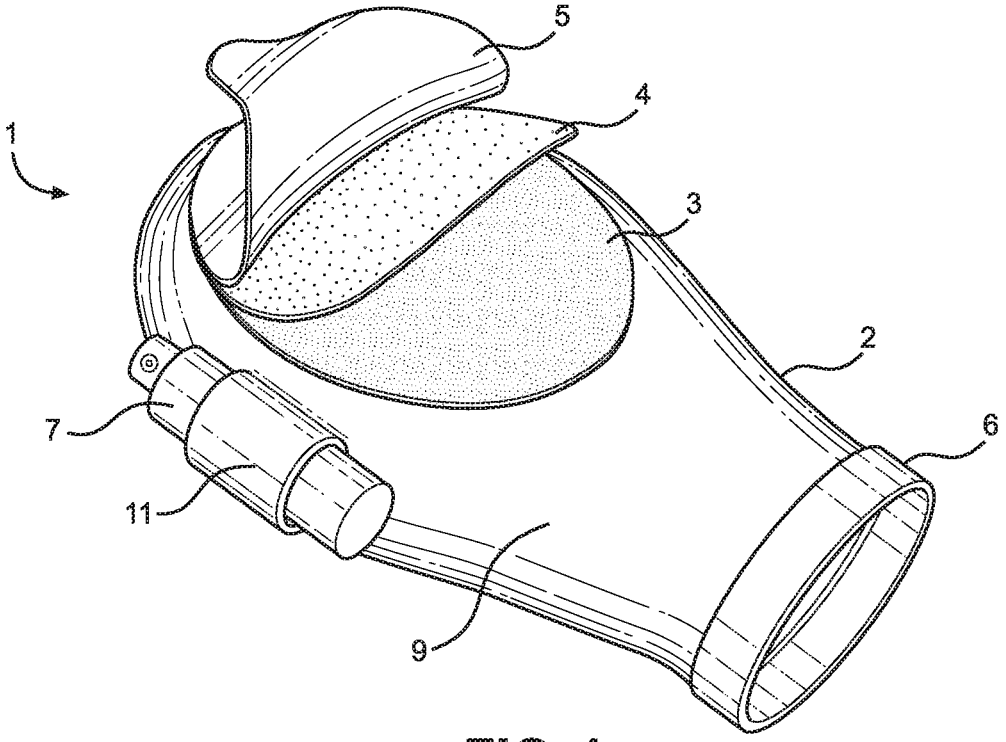
FIG. 1 depicts a perspective view of a first exemplary embodiment of a reusable hand article for cleaning, having a water-resistant layer, an absorbent layer, and a sealant layer.

Reference is made herein to the attached drawings. Like reference numerals are used throughout the drawings to depict like or similar elements of the invention. The figures are intended for representative purposes only and should not be considered limiting in any respect.

Reference is now made to the drawings, which depict one or more exemplary embodiments of the invention.

Figure 2:
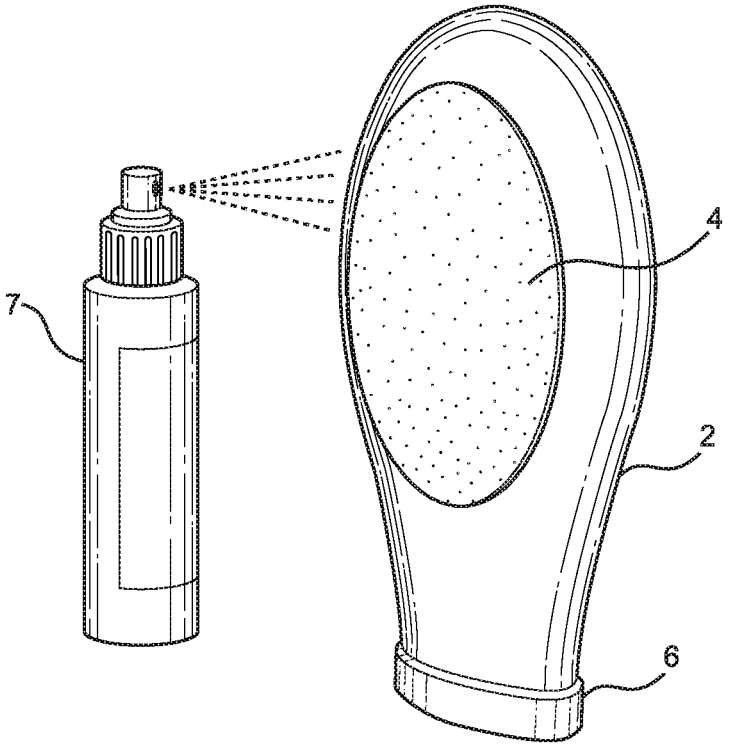
FIG. 2 depicts a perspective view of the first exemplary embodiment of the reusable hand article for cleaning, with a liquid solution being applied to the absorbent layer of the reusable hand article.
Figure 3:
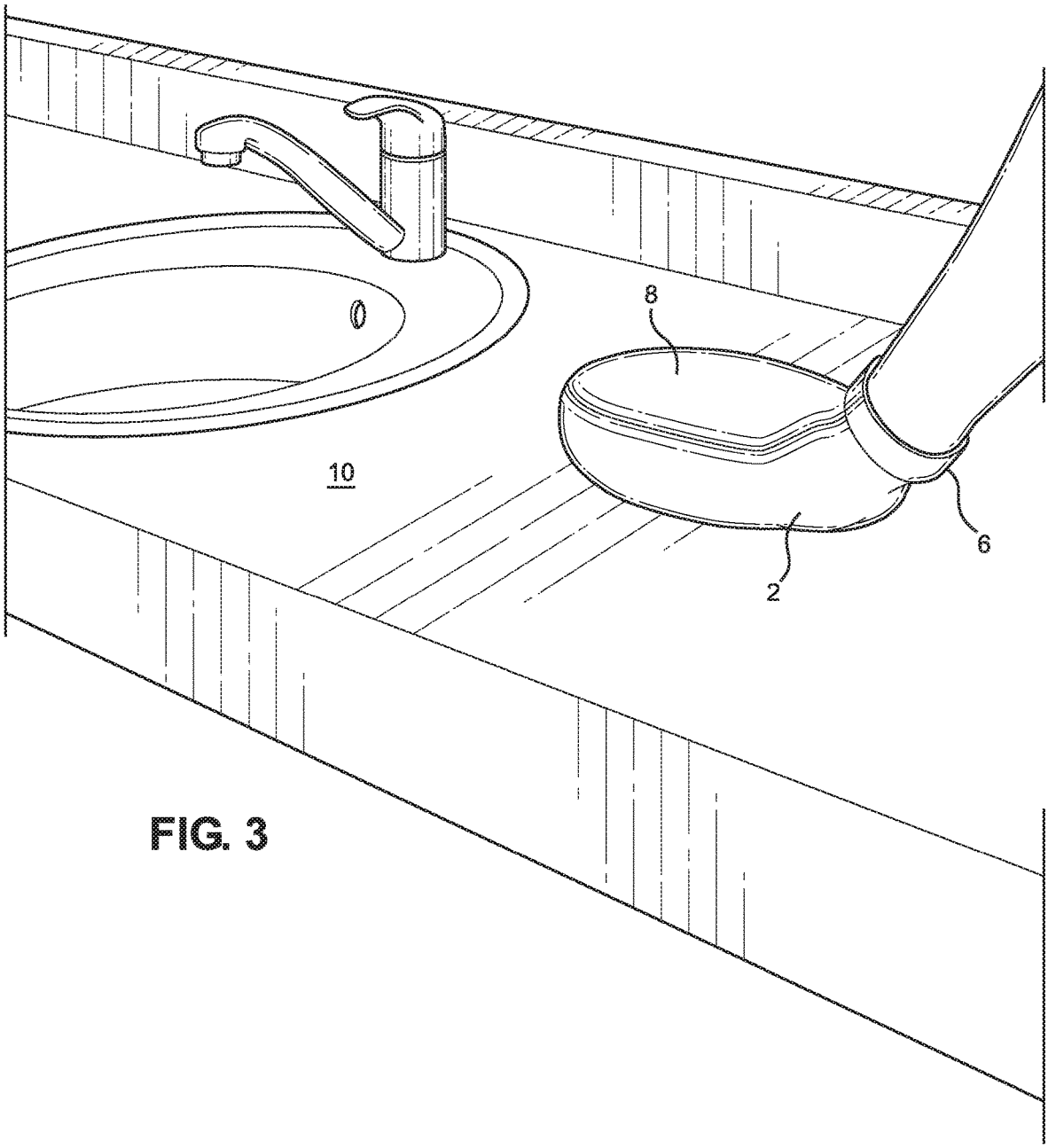
FIG. 3 depicts a perspective view of the first exemplary embodiment of the reusable hand article for cleaning, wherein the reusable hand article is being used to clean a contaminated surface.

Referring now to FIGS. 1-3, there are depicted several views of a first exemplary embodiment of a reusable hand article for cleaning, having a water-resistant layer, an absorbent layer, and a sealant layer. The reusable hand article 1 includes a sleeve 2, having a top layer 8 connected to a bottom layer 9, having an opening on a rearward side thereof configured to receive a hand therethrough (i.e., between the top layer 8 and the bottom layer 9), and having a closed portion on a forward side thereof configured to secure the hand in the sleeve 2.

The reusable hand article 1 includes a water-resistant layer 3, attached to an exterior of the bottom layer 9, configured to isolate the sleeve 2 from a liquid solution, and an absorbent layer 4, attached to an outer surface of the water-resistant layer 3, configured to absorb the liquid solution therein when the liquid solution is applied thereto. In this manner, the absorbent layer 4 is isolated from the hand when the hand is placed inside the sleeve 2, thereby protecting the hand from exposure to chemicals, such as sanitization agents, in the liquid solution during use while cleaning.

In the shown embodiment, the reusable hand article 1 includes a sealant layer 5, removably attached to an outer surface of the absorbent layer 4, such that the sealant layer 5 is configured to retain moisture within the absorbent layer 4 when the reusable hand article 1 is stored or otherwise not in use. In this manner, a duration of use of the reusable hand article 1 may be maximized, the liquid solution is preserved and is not wasted, and in addition, storage of the reusable hand article 1 does not unintentionally expose a storage environment to the liquid solution absorbed within the absorbent layer 4.

In the shown embodiment, the liquid solution is contained in a liquid solution bottle 7, and may be applied, e.g., sprayed or poured, onto the absorbent layer 4, as depicted in FIG. 2, before use of the reusable hand article 1 in a method of cleaning a surface 10, as depicted in FIG. 3. In the shown embodiment, the reusable hand article 1 includes an elastic band 6, attached to the sleeve 2 and configured to secure the hand in the sleeve 2, thereby preventing or reducing slippage or loss of the reusable hand article 1 during use.

In the shown embodiment, the reusable hand article 1 includes a flap 11 thereon, for storage of an item, such as the liquid solution bottle 7. Generally, the flap 11 may be an optional feature in a particular embodiment of the present invention, but it may be desirable in certain instances to help an individual using the reusable hand article 1 to organize supplies needed for cleaning. In the shown embodiment, the flap 11 is disposed on a side of the sleeve 2, but in alternate embodiments, the flap 11 may be disposed on another portion of the reusable hand article 1, such as the top layer 8. In some embodiments, the flap includes a loop structure, and may retain the liquid solution bottle 7 therein by an elasticity of the loop structure, and/or by frictional engagement with the liquid solution bottle 7, as needed. In this manner, the liquid solution bottle 7 may be kept with the reusable hand article 1 so as to organize cleaning materials and prevent loss or misplacement of one or more items needed for cleaning.

Generally, the water-resistant layer 3 is comprised of a water-resistant or hydrophobic material, or a coating, configured to minimize or prevent penetration of the liquid solution therethrough. Exemplary water-resistant materials that may be used for the water-resistant layer 3 include rubber, latex, and the like. In some embodiments, the absorbent layer 4 is comprised of a liquid-absorbing material, such as a sponge, a cotton, or a cloth, configured to absorb the liquid solution therein for later application to the surface 10 during cleaning. In this manner, the reusable hand article 1 may be constructed using materials that are economical, environmentally friendly, readily available, and suitable for the intended use.

In some embodiments, the absorbent layer 4 is removably attached to the water-resistant layer 3 by an adhesive, thereby enabling the individual to remove or replace the absorbent layer 4 before or after use of the reusable hand article 1. The adhesive may be any adhesive suitable for this purpose, and may be a water-resistant adhesive, such that the adhesive does not loosen or dissolve when exposed to the liquid solution. The adhesive may be applied to an inner surface of the absorbent layer 4, the outer surface of the water-resistant layer 3, or both, such that the adhesive is positioned between the water-resistant layer 3 and the absorbent layer 4. In this manner, the absorbent layer 4 may be removed and disposed of after exhausting its use, and replaced with a new absorbent layer 4 before further use of the reusable hand article 1.

In some embodiments, the reusable hand article 1 is microwave-safe and/or is comprised of one or more microwave-safe materials. In this manner, the individual is able to sanitize the reusable hand article 1, or a component or portion thereof, such as the absorbent layer 4, by microwaving the reusable hand article 1 (or component or portion thereof) between uses. In this manner, the reusable hand article 1 itself does not spread contaminants between surfaces and/or between uses.

In the shown embodiment, the water-resistant layer 3 is oval-shaped and is eclipsed by a perimeter of the sleeve 2. In this manner, the water-resistant layer 3 isolates and protects the sleeve 2 from the liquid solution. In addition, in the shown embodiment, the absorbent layer 4 is oval-shaped and is eclipsed by the perimeter of the sleeve 2. In this manner, the absorbent layer 4 is sized to absorb a controlled volume of the liquid solution, and is configured to be applied to the surface 10 during use in cleaning the surface 10, thereby minimizing waste of the liquid solution. In addition, in the shown embodiment, the reusable hand article 1 includes an oval-shaped sealant layer 5 removably attached to an outer surface of the absorbent layer 4, such that the oval-shaped sealant layer 5 is eclipsed by the perimeter of the sleeve 2. In this manner, the oval-shaped sealant layer 5 is sized to prevent loss of moisture from the absorbent layer 4 between or after uses.

In particular embodiments, the reusable hand article 1, the flap 11 thereon, and the liquid solution bottle 7 are sized and configured to facilitate travel with the reusable hand article 1 and the liquid solution bottle 7. In this manner, the individual may easily carry the reusable hand article 1 and the liquid solution bottle 7 with them while traveling, e.g., on a cruise ship, a bus, an airplane, a train, or during use of another mode of transportation. In some embodiments, the liquid solution bottle 7 is sized and configured for long-term use in a building or other structure, such as an office or a domicile, as needed.

Figure 4:
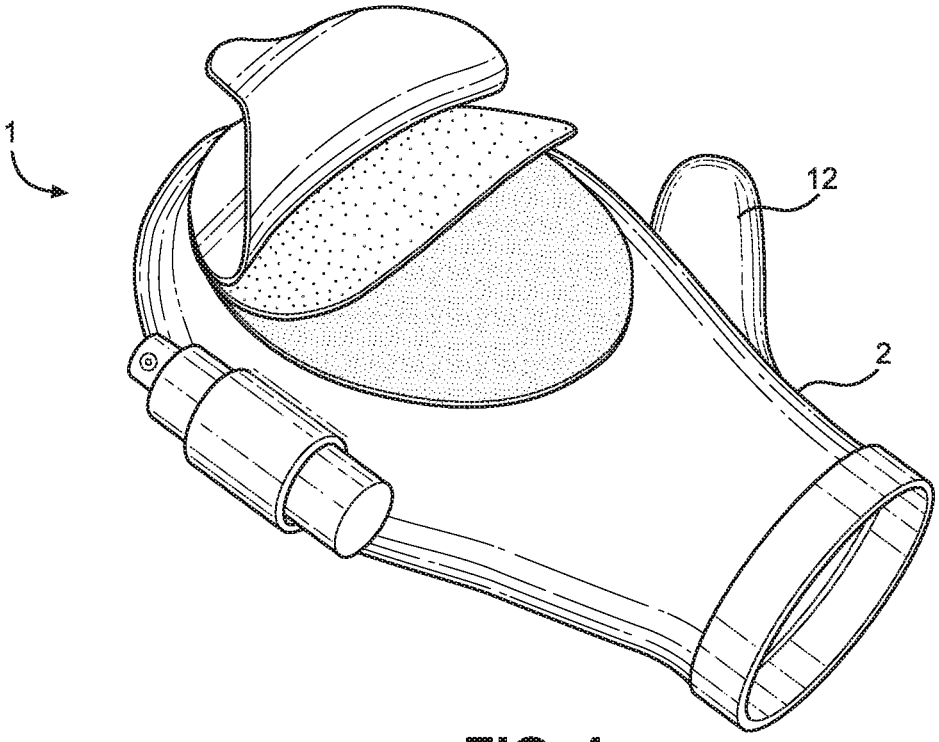
FIG. 4 depicts a perspective view of a second exemplary embodiment of a reusable hand article for cleaning, having a water-resistant layer, an absorbent layer, and a sealant layer, and a thumb insert.
Figure 5:
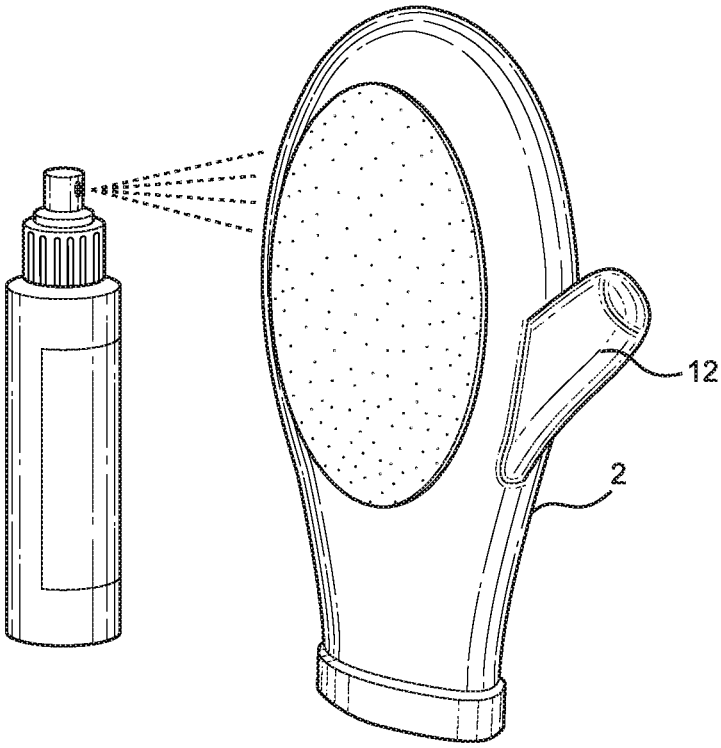
FIG. 5 depicts a perspective view of the second exemplary embodiment of the reusable hand article for cleaning, with a liquid solution being applied to the absorbent layer of the reusable hand article.
Figure 6:
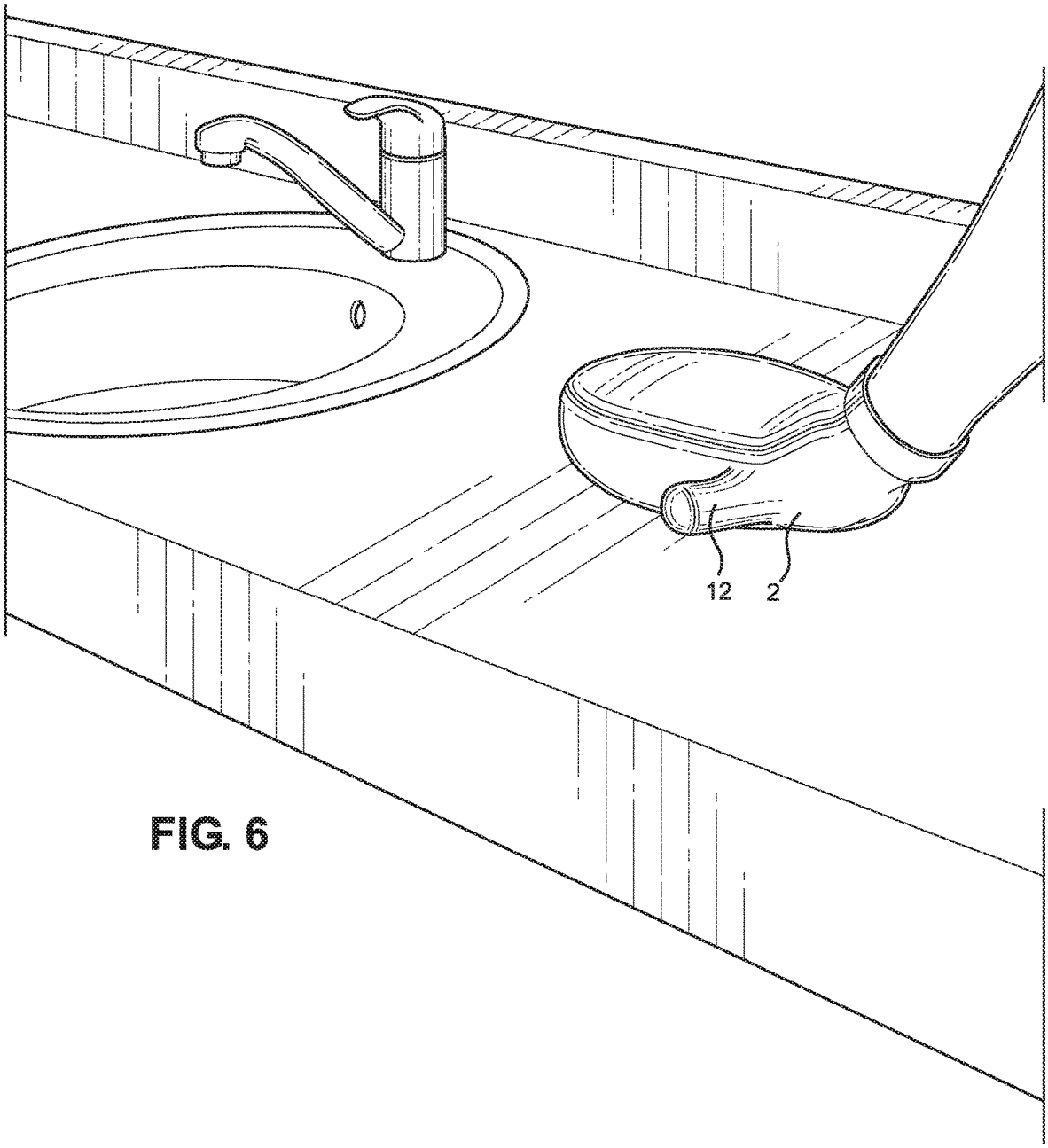
FIG. 6 depicts a perspective view of the second exemplary embodiment of the reusable hand article for cleaning, wherein the reusable hand article is being used to clean a contaminated surface.

Referring now to FIGS. 4-6, there are depicted several views of a second exemplary embodiment of a reusable hand article for cleaning, having a water-resistant layer, an absorbent layer, a sealant layer, and a thumb insert. In the shown embodiment, the reusable hand article 1 includes all the features of the first exemplary embodiment (see FIGS. 1-3), and also includes a thumb insert 12 thereon, for insertion of a thumb of the hand placed in the sleeve 2. Generally, the thumb insert 12 may be an optional feature in a particular embodiment of the present invention, but it may be desirable in certain instances to help the individual to grab or grip an item or a surface when cleaning the item or the surface with the reusable hand article 1. In the shown embodiment, the thumb insert 12 is attached to a left side of the sleeve 2, but in alternate embodiments, the thumb insert 12 may be attached to a right side of the sleeve 2. In this manner, the reusable hand article 1 can be configured for use by a right hand or a left hand of the individual. In some embodiments, the reusable hand article 1 may be mitten-shaped.

In some embodiments, the sleeve 2 is glove-shaped, having the thumb insert 12 in addition to a plurality of digit inserts, thereby enabling the individual to more particularly grasp the item or the surface during use. In particular embodiments, the plurality of digit inserts includes four digit inserts, to accept and retain each of four digits of the hand of the individual therein. In this manner, the plurality of digit inserts may be configured to conform more closely to a shape of the hand.

Figure 7:
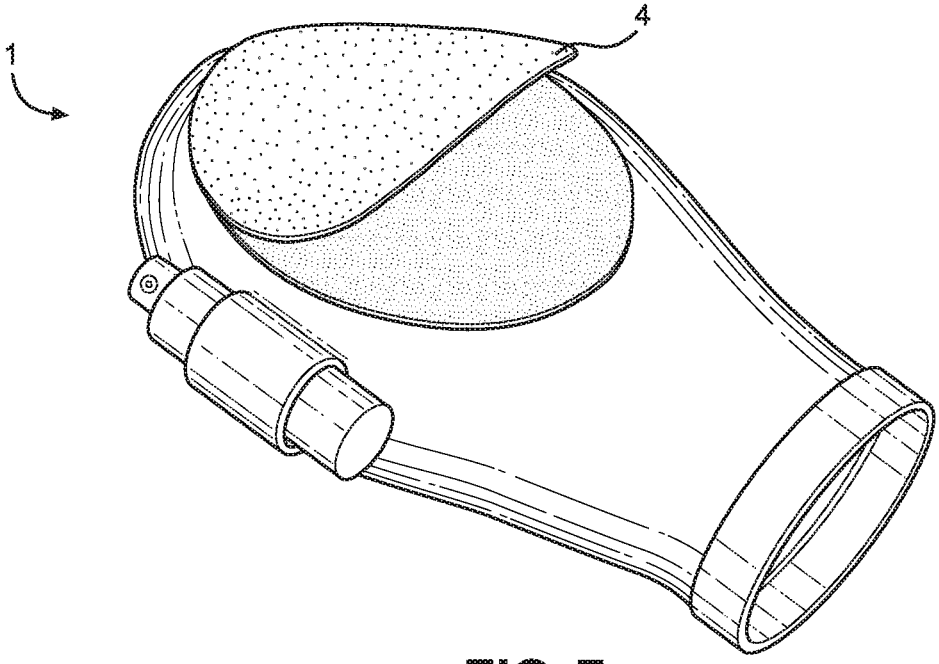
FIG. 7 depicts a perspective view of a third exemplary embodiment of a reusable hand article for cleaning, having a water-resistant layer, and an absorbent layer.
Figure 8:
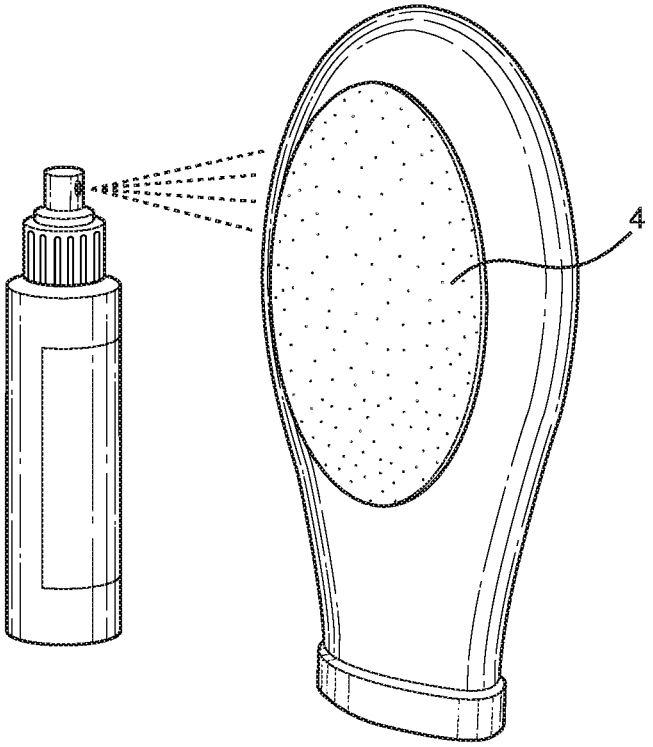
FIG. 8 depicts a perspective view of the third exemplary embodiment of the reusable hand article for cleaning, with a liquid solution being applied to the absorbent layer of the reusable hand article.
Figure 9:
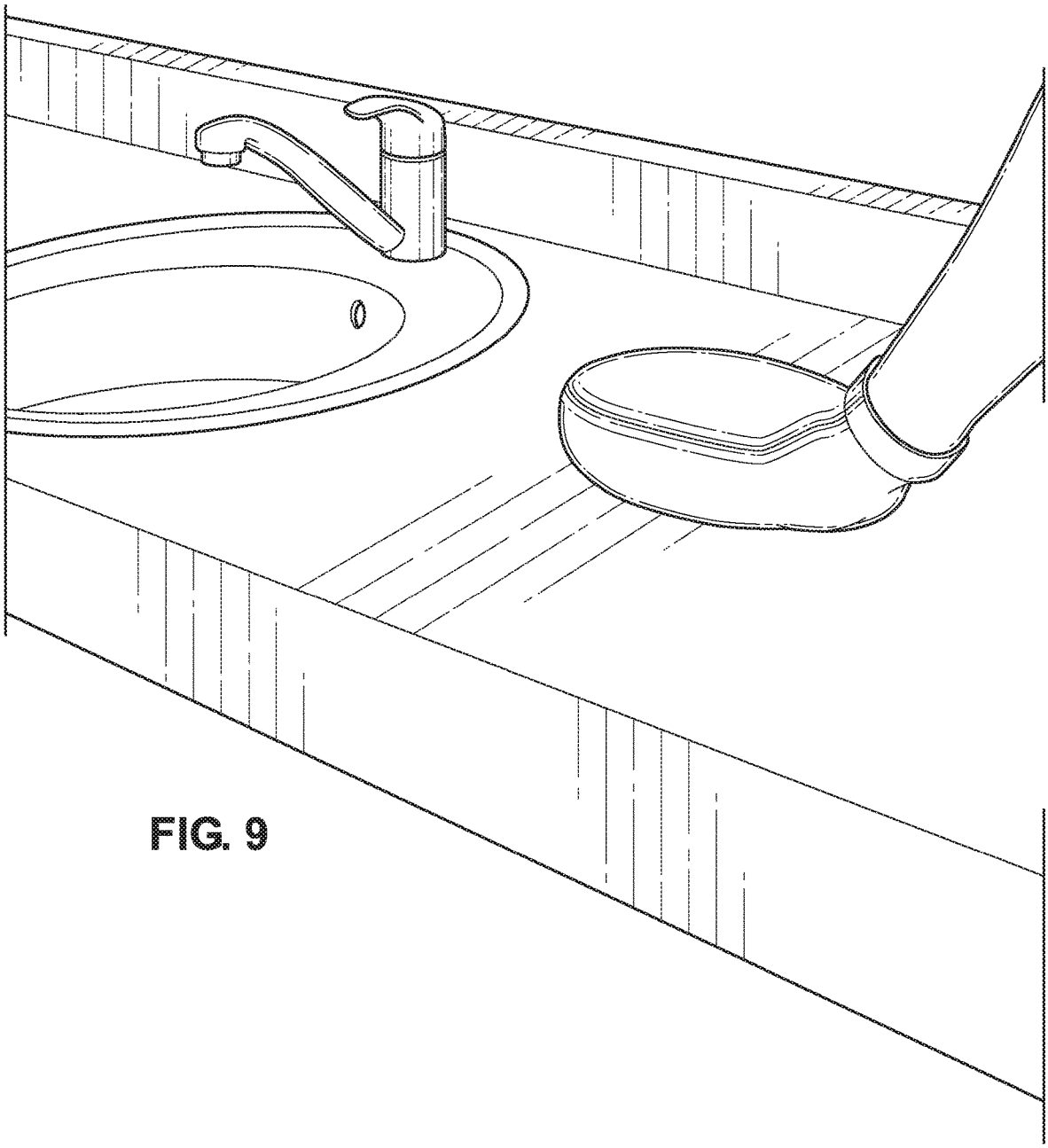
FIG. 9 depicts a perspective view of the third exemplary embodiment of the reusable hand article for cleaning, wherein the reusable hand article is being used to clean a contaminated surface.

Referring now to FIGS. 7-9, there are depicted several views of a third exemplary embodiment of a reusable hand article for cleaning, having a water-resistant layer, and an absorbent layer. In the shown embodiment, the reusable hand article 1 includes many of the features of the first exemplary embodiment (see FIGS. 1-3), but does not include the sealant layer. In some embodiments, such as embodiments in which there is no sealant layer reversibly attachable to the reusable hand article 1, the reusable hand article 1 may be placed inside an air-tight container, such as a plastic bag or box, to preserve moisture in the absorbent layer 4 between or after uses. In this manner, if the reusable hand article 1 is provided without the sealant layer, or if the sealant layer is unable to attach to the absorbent layer 4, the moisture in the absorbent layer 4 may be preserved and a use of the reusable hand article 1 may be prolonged or maximized.

Figure 10:
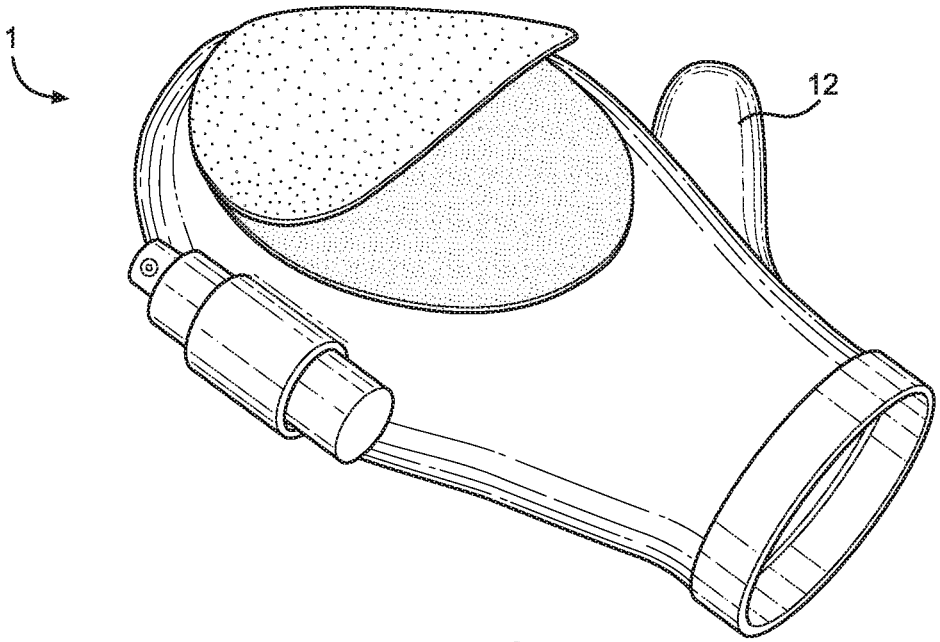
FIG. 10 depicts a perspective view of a fourth exemplary embodiment of a reusable hand article for cleaning, having a water-resistant layer, and an absorbent layer.
Figure 11:
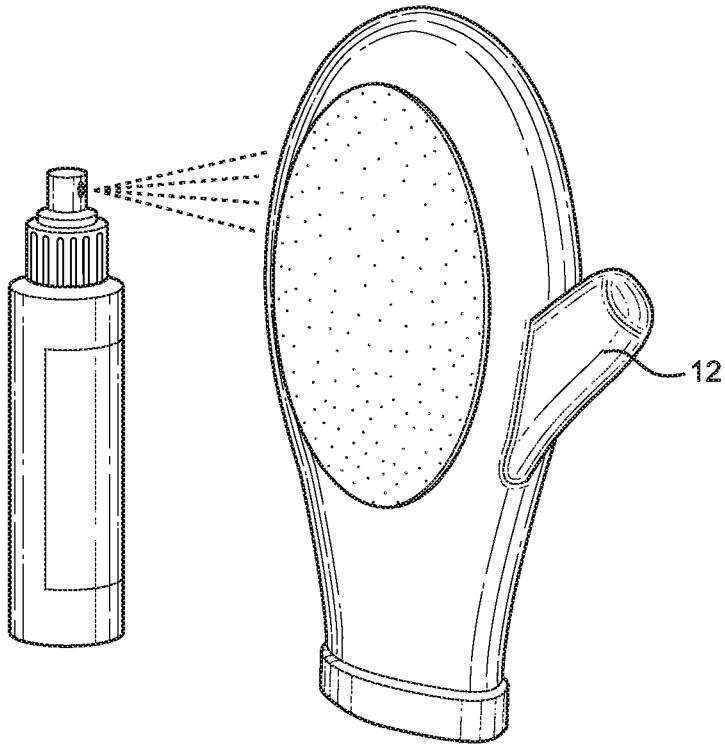
FIG. 11 depicts a perspective view of the fourth exemplary embodiment of the reusable hand article for cleaning, with a liquid solution being applied to the absorbent layer of the reusable hand article.
Figure 12:
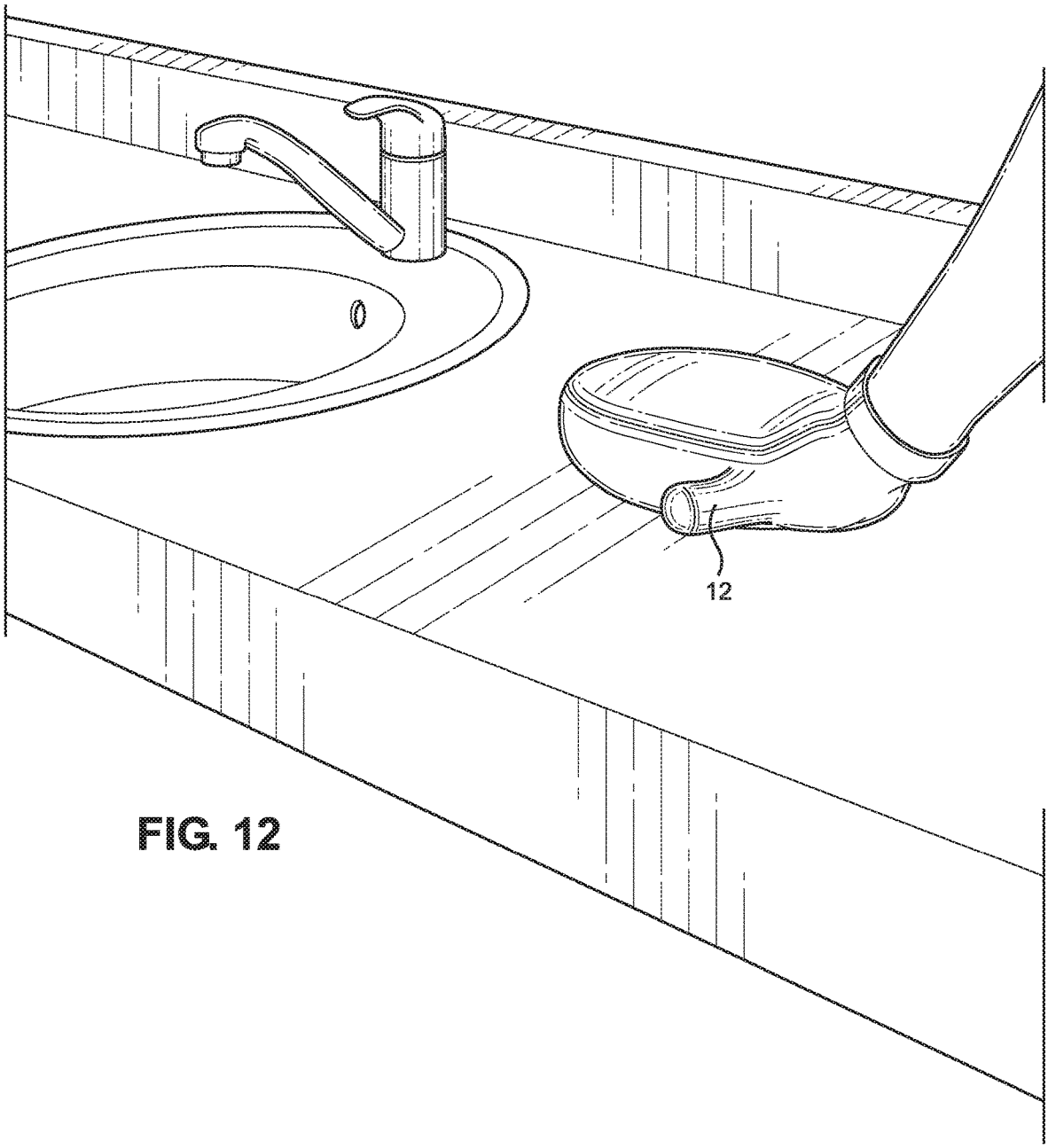
FIG. 12 depicts a perspective view of the fourth exemplary embodiment of the reusable hand article for cleaning, wherein the reusable hand article is being used to clean a contaminated surface.

Referring now to FIGS. 10-12, there are depicted several views of a fourth exemplary embodiment of a reusable hand article for cleaning, having a water-resistant layer, an absorbent layer, and a thumb insert. In the shown embodiment, the reusable hand article 1 includes all of the features of the third exemplary embodiment (see FIGS. 7-9), and further includes the thumb insert 12, as described elsewhere herein.

Figure 13A:
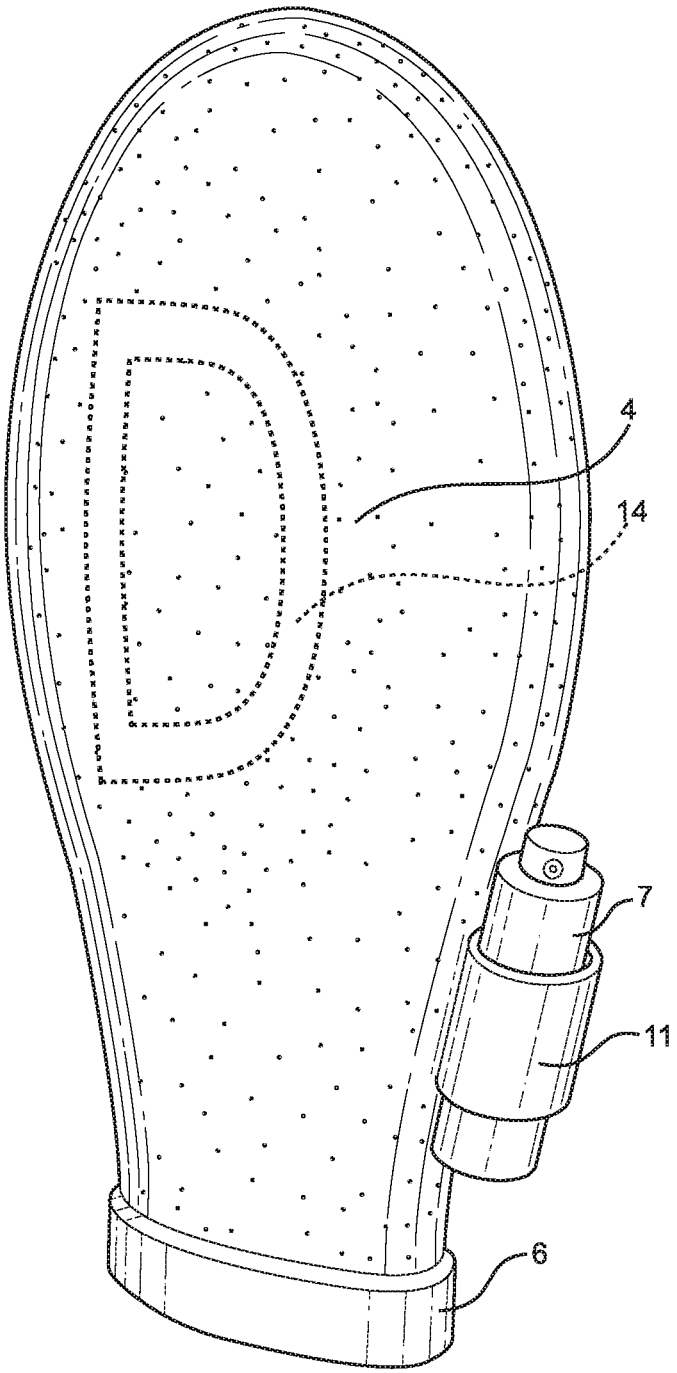
FIG. 13A depicts a perspective view of the abrasive layer of an embodiment of the reusable hand article for cleaning.
Figure 13B:
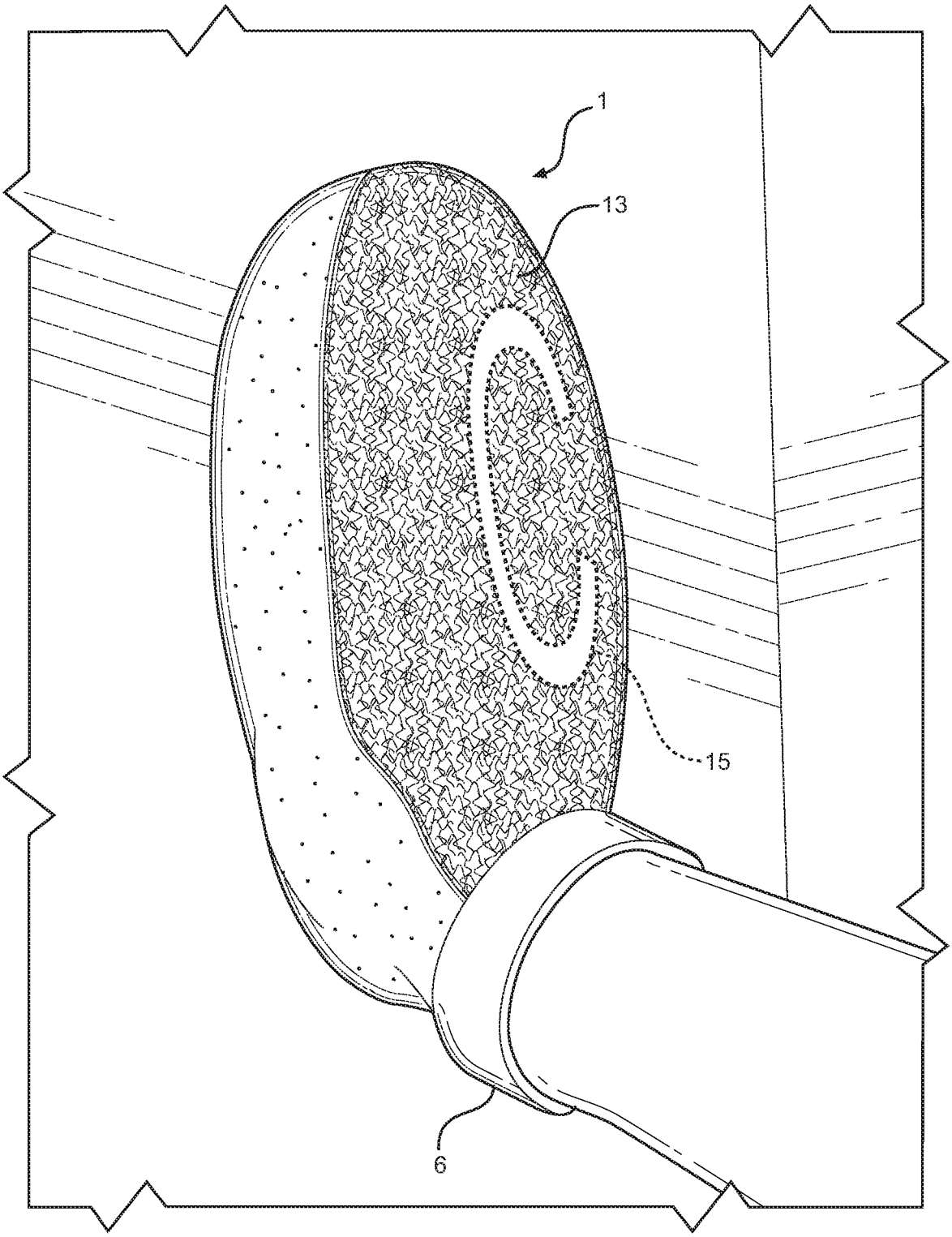
FIG. 13B depicts a perspective view of the absorbent layer of an embodiment of the reusable hand article for cleaning.

Referring now to FIGS. 13A and 13B, there are depicted a perspective view of the abrasive layer of an embodiment of the reusable hand article for cleaning and a perspective view of the absorbent layer of an embodiment of the reusable hand article for cleaning, respectively. In the illustrated embodiment of FIG. 13A, the reusable hand article 1 comprises an absorbent layer 4 disposed across an entirety of the bottom layer from an upper end to the elastic band 6, such that the surface area of the absorbent layer 4 is maximized to allow a user to disinfect a surface more quickly. Similar to previously described embodiments, the absorbent layer 4 is contemplated to be removably securable to the water-resistant layer via an adhesive or other suitable fastener, such as hook and loop fasteners. The water-resistant layer is contemplated to be disposed across the bottom layer of the reusable hand article 1 such that the water-resistant layer is coextensive with the absorbent layer 4. In this manner, disinfectant disposed on and within the absorbent layer 4 does not transfer into the bottom layer of the reusable hand article 1 to wet the user's hand. As elsewhere described herein, a sealant layer can be removably securable over the absorbent layer 4 to maintain disinfectant within the absorbent layer 4 until a user desires to disinfect a surface. In the illustrated embodiment, the absorbent layer 4 comprises a first indicia 14 thereon, wherein the first indicia 14 is configured to identify which side of the reusable hand article 1 is for disinfecting purposes. In the shown embodiment, the first indicia 14 comprises a "D" to represent the disinfecting nature of the absorbent layer 4, however alternate indicia are also contemplated. In the shown embodiment, the reusable hand article further comprises a flap 11 configured to removably secure the solution bottle 7 therein, such as described above.

In the illustrated embodiment, an abrasive layer 13 is disposed across an entirety of the top layer of the reusable hand article 1. The abrasive layer 13 comprises a rough, textured external surface to facilitate scrubbing to clean a surface. Similar to the absorbent layer 4, the abrasive layer 13 is contemplated to be coextensive with an entirety of the top layer to maximize the surface area available for scrubbing to allow a user to clean a desired more quickly. It should be understood that while in the previously described preferred embodiment the abrasive layer 13 is coextensive with an entirety of the top layer, alternate embodiments contemplate abrasive layers 13 comprising lesser areas of coverage over the top layer. Such embodiments provide benefits, such as decreased product and manufacturing costs, as well as localized scrubbing capability. In the illustrated embodiment, a second indicia 15 is disposed on the abrasive layer 13, wherein the second indicia 15 is distinct from the first indicia 14 to distinguish the abrasive layer 13 from the absorbent layer 4. In the shown embodiment, the second indicia 15 comprises a "C" to represent the side for cleaning a surface, however alternate markings are contemplated. The abrasive layer 13 is configured to remove dirt and debris from a surface without damaging the underlying surface to allow a user to disinfect the entirety of the underlying surface, rather than leaving portions of the underlying surface contaminated underneath a layer of dirt or grime. In alternate embodiments, the reusable hand article 1 can comprise any combination of a pair of opposed absorbent layers 4 or a pair of opposed abrasive layers 13 in addition to the shown embodiment featuring an absorbent layer 4 disposed opposite an abrasive layer 13.

Figure 14:
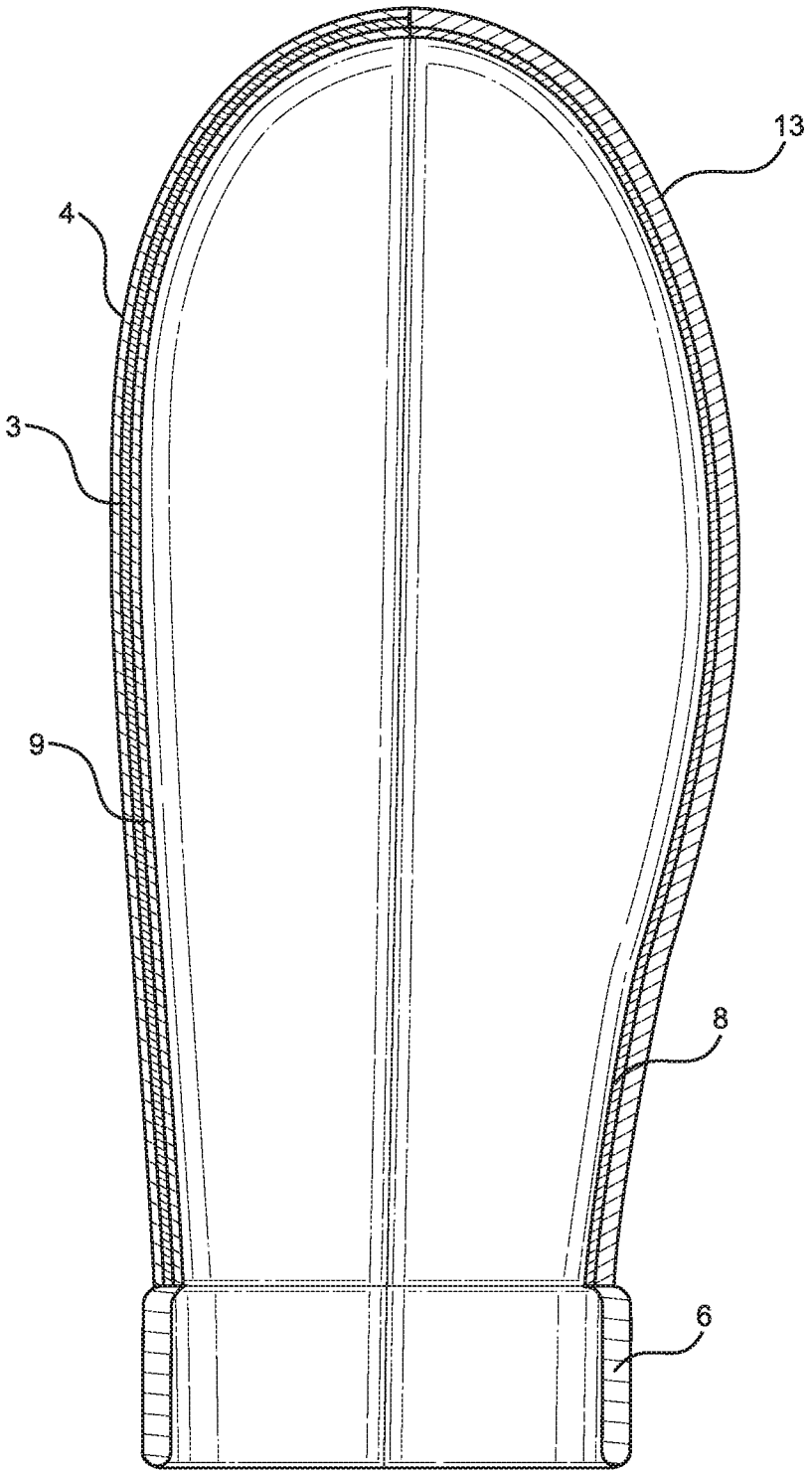
FIG. 14 depicts a cross-sectional view of an embodiment of the reusable hand article for cleaning.

Referring now to FIG. 14, there is depicted a cross-sectional view of an embodiment of the reusable hand article for cleaning. The sleeve comprises a top layer 8 affixed to a bottom layer 9 as previously described herein. In the illustrated embodiment, a water-resistant layer 3 is permanently affixed to the bottom layer 9, wherein the water-resistant layer 3 is impermeable to liquid, thereby preventing disinfectant or other liquids from passing into the bottom layer 9 or entering an interior of the sleeve. The absorbent layer 4 is affixed to the water-resistant layer 9, wherein the water-resistant layer 9 is coextensive with the absorbent layer 4, thereby ensuring that any disinfectant impregnated within the absorbent layer 4 is retained therein. Similar to embodiments previously described herein, the absorbent layer 4 is removably securable to the water-resistant layer 3 via an adhesive. The top layer 8 further comprises an abrasive layer 13 affixed thereto. It is contemplated that the abrasive layer 13 can be permanently affixed to the top layer 8, or alternatively removably secured to the top layer 8 via similar fastening mechanisms utilized for the absorbent layer 4. The abrasive layer 13 comprises a rough textured surface configured to scrub dirt and grime from a desired surface. Such textured surfaces are contemplated to include sandpaper grit, rigid pleating, wire strands similar to steel wool, and the like. The abrasive layer 13 is contemplated to be non-porous and impermeable to liquids to prevent seepage into the interior of the sleeve if the abrasive layer is used to scrub a wet surface. Additionally, both the absorbent layer 4 and the abrasive layer 13 are contemplated to comprise microwave safe materials. In the shown embodiment, since the abrasive layer 13 suffers the greatest wear and tear during use, the abrasive layer 13 comprises a greater thickness than that of the remaining layers in order to prolong the lifetime of the reusable hand article. In embodiments wherein the abrasive layer 13 is removably securable to the top layer 8, the abrasive layer 13 can further be replaced as necessary to extend the effective lifetime of the reusable hand article.

In one use, the user inserts their hand through the elastic band 6 to secure the reusable hand article about their hand. The sleeve is then rotated about the user's hand until the top layer 8 is disposed adjacent to a palm side of the hand. The user then scrubs the desired surface with the abrasive layer 13 disposed on the top layer 8 of the sleeve. This is key, as accumulated dirt and grime disposed on the surface can interfere with the effectiveness of a disinfectant applied to the surface. The accumulated dirt and grime can prevent the disinfectant from properly contacting the surface for the required length of time. Once the surface is properly scrubbed, the user can then rotate the sleeve about their wrist such that the bottom layer 9 is disposed adjacent to the user's palm. A disinfectant is then applied to the absorbent layer 4 and the absorbent layer 4 is then wiped across the surface to be disinfected for a desired length of time. In some embodiments, the disinfectant is dispensed from the solution bottle via a spray nozzle. Similarly, the disinfectant can be further applied directly to the surface before wiping with the absorbent layer 4. In order to ensure full coverage, this step may be repeated several times to ensure the absorbent pad 4 is saturated with disinfectant during use. For example, many disinfectants fail to fully eradicate germs and bacteria unless present on the surface for two to three minutes. As such, one use includes continually wetting the surface with disinfectant for a length of time between two to three minutes to fully disinfect the surface. Once the surface has been fully disinfected, the process can be repeated to clean any remaining surfaces. After the surfaces are fully cleaned and disinfected, the user can place the reusable hand article within a microwave and activate the microwave to eradicate any germs or bacteria remaining on the reusable hand article.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

We claim:

1. A multi-surfaced cleaning implement, comprising:

a sleeve having a top layer connected to a bottom layer;

wherein the sleeve is defining an opening on a rearward side thereof configured to receive a hand between the top layer and the bottom layer, and having a closed portion on a forward side thereof configured to secure the hand in the sleeve;

a water-resistant layer directly permanently attached to an exterior of the bottom layer;

wherein the water-resistant layer is configured to repel a liquid solution;

an absorbent layer directly attached to an outer surface of the water-resistant layer;

wherein the multi-surfaced cleaning implement is mitten-shaped;

wherein the absorbent layer is configured to absorb the liquid solution therein;

an abrasive layer directly attached to an outer surface of the top layer;

wherein the abrasive layer includes a textured surface thereon;

wherein the multi-surfaced cleaning implement is made of a microwave-safe material;

wherein a user places the multi-surfaced cleaning implement within a microwave oven and activates the microwave oven to eradicate any germs or bacteria remaining on the multi-surfaced cleaning implement;

wherein the absorbent layer is removably attached to the water-resistant layer by an adhesive;

wherein the opening of the sleeve includes an elastic band, configured to secure the hand in the sleeve;

wherein the water-resistant layer is coextensive with the bottom layer;

further comprising a first indicia on an exterior of the absorbent layer and a second indicia on an exterior of the abrasive layer;

wherein the first indicia is distinct from the second indicia; and wherein the absorbent layer is coextensive with the water-resistant layer.

2. A multi-surfaced cleaning implement, consisting of:

a sleeve having a top layer connected to a bottom layer;

wherein the sleeve is defining an opening on a rearward side thereof configured to receive a hand between the top layer and the bottom layer, and having a closed portion on a forward side thereof configured to secure the hand in the sleeve;

a water-resistant layer permanently attached to an exterior of the bottom layer;

wherein the water-resistant layer is configured to repel a liquid solution;

an absorbent layer attached to an outer surface of the water-resistant layer;

wherein the absorbent layer is configured to absorb the liquid solution therein;

an abrasive layer directly attached to an outer surface of the top layer;

wherein the abrasive layer includes a textured surface thereon;

a flap disposed on an exterior of the multi-surfaced cleaning implement;

wherein the multi-surfaced cleaning implement is mitten-shaped;

wherein the flap is configured to removably secure a bottle therein;

wherein the bottle includes a spray nozzle configured to dispense disinfectant stored within an interior volume of the bottle;

wherein the multi-surfaced cleaning implement is made of a microwave-safe material;

wherein a user places the multi-surfaced cleaning implement within a microwave oven and activates the microwave oven to eradicate any germs or bacteria remaining on the multi-surfaced cleaning implement;

wherein the flap is permanently affixed to the exterior of the multi-surfaced cleaning implement at opposing ends thereof defining a channel therethrough;

wherein the flap includes an elastic material;

wherein the absorbent layer is removably attached to the water-resistant layer by an adhesive;

wherein the opening of the sleeve includes an elastic band, configured to secure the hand in the sleeve;

wherein the water-resistant layer is coextensive with the bottom layer;

further comprising a first indicia on an exterior of the absorbent layer and a second indicia on an exterior of the abrasive layer;

wherein the first indicia is distinct from the second indicia; and wherein the absorbent layer is coextensive with the water-resistant layer.

* * * * *